US007120956B1

(12) United States Patent
Liao

(10) Patent No.: US 7,120,956 B1
(45) Date of Patent: Oct. 17, 2006

(54) COMBINATION MATTRESS

(76) Inventor: Hsiu-Chen Liao, 8F., No. 69, Sec. 3, Hueijhong Rd., Nantun District, Taichung City 408 (TW)

( * ) Notice: Subject to any disclaimer, the term of this patent is extended or adjusted under 35 U.S.C. 154(b) by 0 days.

(21) Appl. No.: 11/239,404

(22) Filed: Sep. 30, 2005

(30) Foreign Application Priority Data

Jun. 20, 2005 (TW) ..... 94120491 A

(51) Int. Cl.
*A47C 27/20* (2006.01)

(52) U.S. Cl. ..... 5/719; 5/718

(58) Field of Classification Search ..... 5/718–720, 5/722–724, 727, 730, 740, 935; 267/142, 267/143, 145
See application file for complete search history.

(56) References Cited

U.S. PATENT DOCUMENTS 1,276,361 A * 8/1918 Hobert ..... 5/722
3,633,228 A * 1/1972 Zysman ..... 267/152
3,720,966 A * 3/1973 Zysman ..... 5/655.7
4,194,255 A * 3/1980 Poppe ..... 267/153
4,809,374 A * 3/1989 Saviez ..... 5/420
5,355,455 A * 10/1994 Hilgendorf et al. ..... 710/306
6,704,962 B1 * 3/2004 Choi ..... 5/740

* cited by examiner

*Primary Examiner*—Michael Trettel
(74) *Attorney, Agent, or Firm*—Browdy and Neimark, PLLC

(57) ABSTRACT

A combination mattress includes a plurality of independent barrels each having two resting faces and an outer peripheral face extending between the two resting faces. Each independent barrel has a recess extended through the two resting faces. The independent barrels are combined together with the outer peripheral faces abutting mutually.

12 Claims, 4 Drawing Sheets

COMBINATION MATTRESS

BACKGROUND OF THE INVENTION

1. Field of the Invention

The present invention relates to a mattress and more particularly to such a combination mattress wherein the user can self adjust the resilience of the combination mattress.

2. Description of the Related Art

A conventional mattress comprises two pads, a spring shelf mounted between the two pads, and a cover mounted around the outer periphery of the two pads and the spring shelf. When a user lies on the mattress, the portion of the mattress contacting the human body is deformed with the profile of the human body, then the spring shelf provides enough support force, so that the user has a comfortable sensation when lying on the mattress.

However, the resilience of the mattress is controlled by the elasticity of the spring shelf, the spring shelf can only provides a single elastic force to support the human body. Thus, if the user wishes to change the resilience of the mattress according to the requirement of the human body, he has to buy another mattress which resilience conforms to the requirement of the human body, thereby increasing the user's economic burden, and causing disturbance in use.

SUMMARY OF THE INVENTION

The primary objective of the present invention is to provide a combination mattress, wherein the user can self adjust the resilience of the combination mattress, so that the combination mattress is used conveniently and comfortably.

Another objective of the present invention is to provide a combination mattress that can change its resilience in a more convenient manner according to the user's requirement.

To achieve the above-mentioned objectives of the present invention, a combination mattress provided by the present invention comprises a plurality of independent barrels each having two resting faces and an outer peripheral face extending between the two resting faces. Each independent barrel has a recess extended through the two resting faces. The independent barrels are combined together with the outer peripheral faces abutting mutually, thus, the user can self adjust the position of the independent barrels to change the resilience of the combination mattress conveniently.

DETAILED DESCRIPTION OF THE INVENTION

Figure 1:
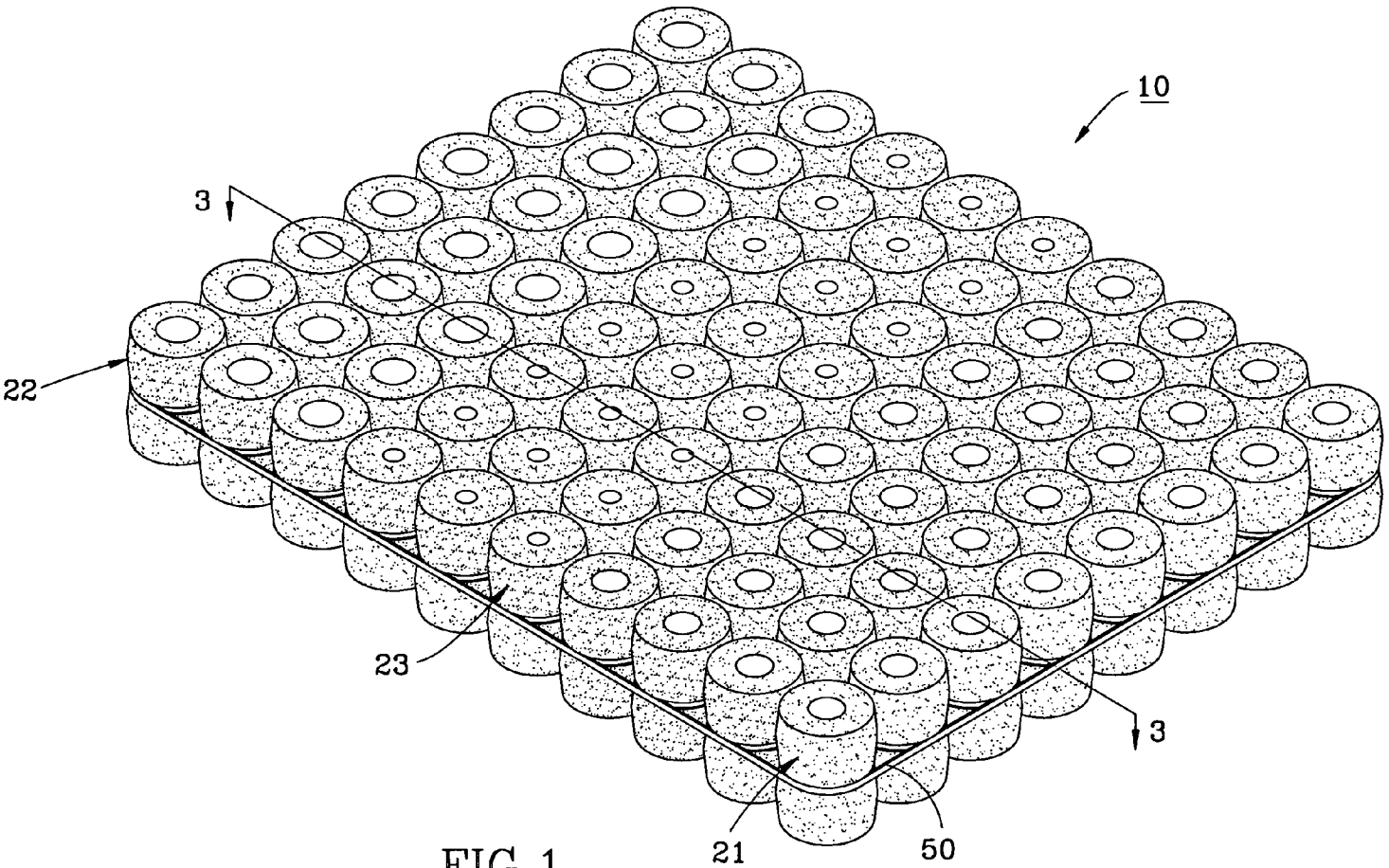
FIG. 1 is a perspective view according to a first preferred embodiment of the present invention.
Figure 2:
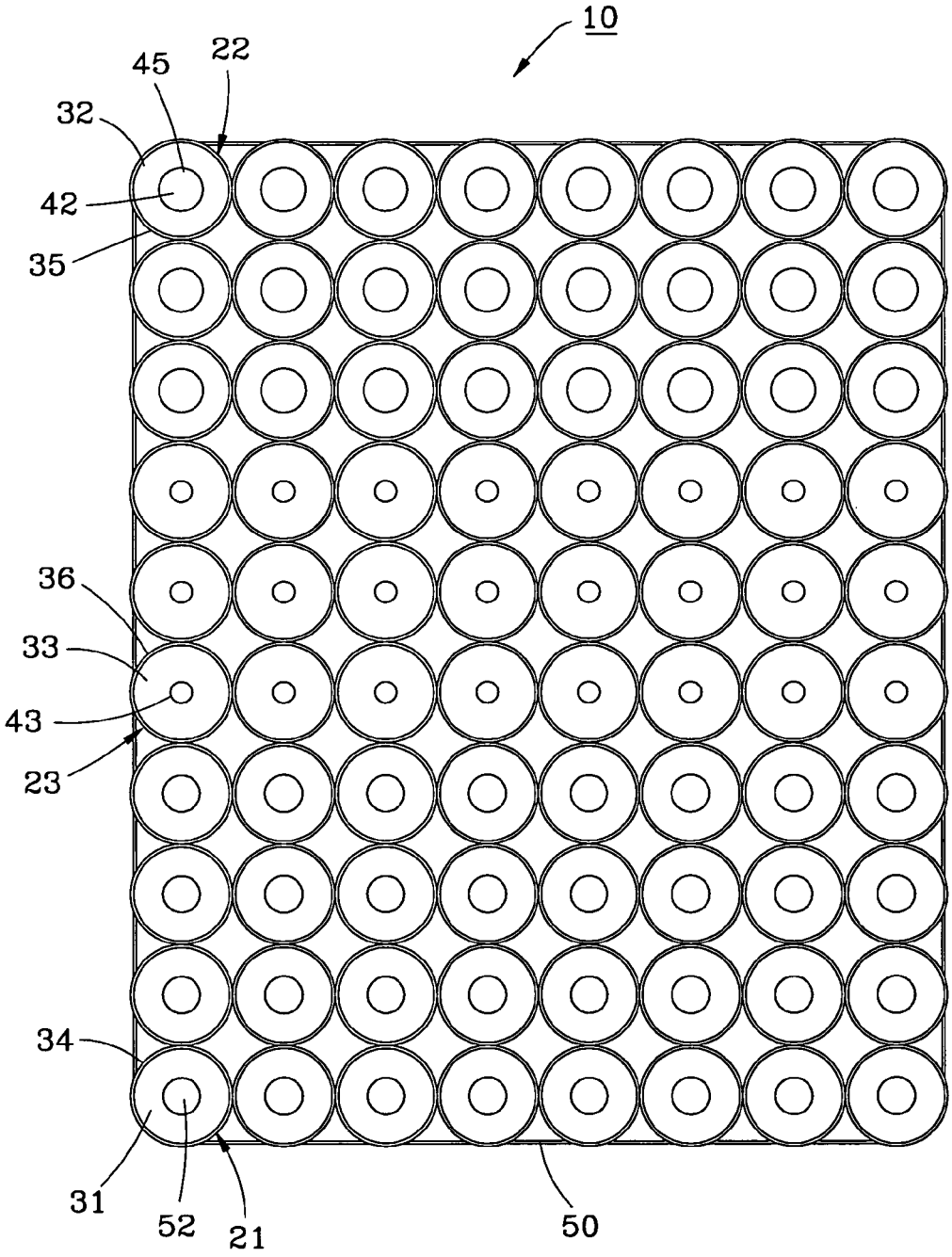
FIG. 2 is a top plan view according to the first preferred embodiment of the present invention.
Figure 3:
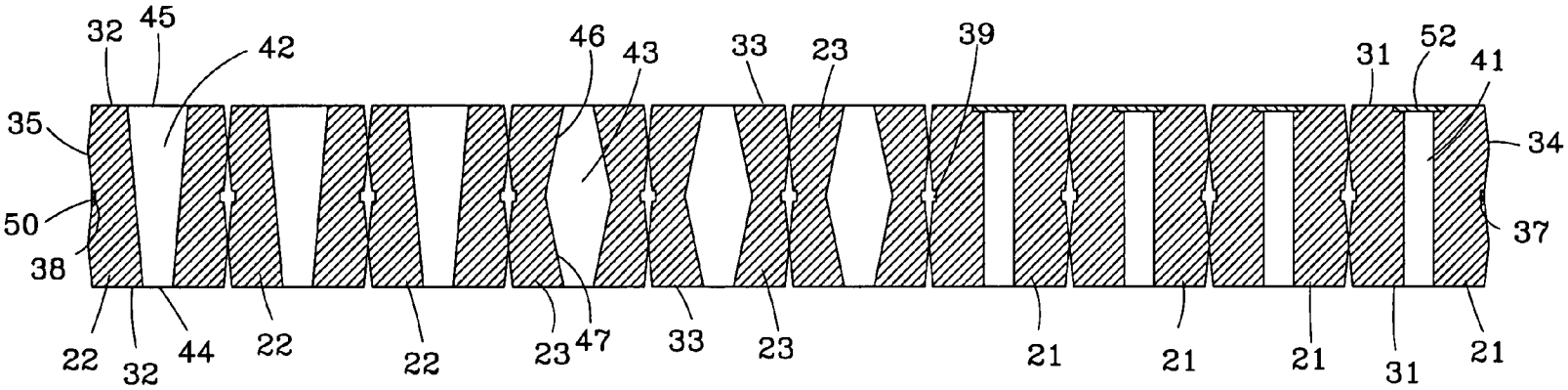
FIG. 3 is a cross-sectional view taken along line 3—3 as shown in FIG. 1.

Referring to FIGS. 1–3, a combination mattress 10 in accordance with the first preferred embodiment of the present invention is shown comprising a plurality of first independent barrels 21, a plurality of second independent barrels 22, a plurality of third independent barrels 23, and a fixing member 50.

Each independent barrel 21–23 is a cylinder made of latex. The independent barrels 21–23 each have two resting faces 31–33, and an outer peripheral face 34–36 extending between the two resting faces 31–33. The outer peripheral face 34–36 of each independent barrel 21–23 has a recessed positioning groove 37–39. The first independent barrel 21 has a first recess 41, which is cylindrical and extended through the center of each resting face 31. The first recess 41 of the first independent barrels 21 has an end having a decorative plate 52, which has figures or is made of material having colors different from that of each independent barrel 21–23 to enhance the outer appearance of the combination mattress 10. The second independent barrel 22 has a second recess 42, which is conic and extended through the center of each resting face 32, and has a first opening 44, and a second opening 45 greater than the first opening 44. The third independent barrels 23 has a third recess 43, which is also extended through the center of each resting face 33, and the third independent barrels 23 has a first inner peripheral face 46 and a second inner peripheral face 47 connecting mutually. The first inner peripheral face 46 extends from one resting face 33 in a gradually divergent manner, and the second inner peripheral face 47 extends from the first inner peripheral face 46 toward the other resting face 33 in a gradually convergent manner. The recesses 41–43 of the independent barrels 21–23 have different shapes so that the independent barrels 21–23 have different strength. In the first preferred embodiment of the present invention, the first independent barrels 21 has a strength greater than that of the second independent barrels 22 and the third independent barrels 23.

The independent barrels 21–23 are arranged in a rectangular matrix with the outer peripheral faces 34–36 abutting mutually, so that the independent barrels 21–23 are arranged in a predetermined manner and the resting faces 31–33 are flush. The fixing member 50 is a belt, which is mounted around the independent barrels 21–23 and inserted into the positioning grooves 37–39 of each independent barrel 21–23. The independent barrels 21–23 are combined together by the fixing member 50 to form of the combination mattress 10 having a rectangular shape.

As shown in FIG. 3, the combination mattress 10 has three second independent barrels 22, three third independent barrels 23 and four first independent barrels 21 aligned with each other in a cross-sectional direction. When the user lies on the resting faces 31–33 of each independent barrel 21–23, the independent barrels 21–23 have different strength, so that the combination mattress 10 has various zones with different resilience to withstand the pressure produced by the user's weight, e.g., the first independent barrels 21 having greater strength abut the user's feet, and the second independent barrels 22 or the third independent barrels 23 having smaller strength abut the user's head, neck or hip.

If the user wishes to change the resilience of the combination mattress 10 or to enhance comfort of lying the combination mattress 10, the user only needs to separate the fixing member 50 from the independent barrels 21–23, then changes the position of the independent barrels 21–23 or changes the number of the independent barrels 21–23, so that the combination mattress 10 is adjusted to satisfy the user's requirement. In addition, when the user buys the combination mattress 10, the pressure distribution state of the user's body is measured, then the independent barrels 21–23 are arranged according to the pressure distribution state of the user's body is measured, so that the combination mattress 10 is adjusted to satisfy the user's requirement.

Thus, the combination mattress 10 combines the independent barrels 21–23 having different strength, so that the user can adjust and change the resilience of the combination mattress 10, thus, the combination mattress 10 is used and adjusted conveniently and comfortably.

Figure 4:
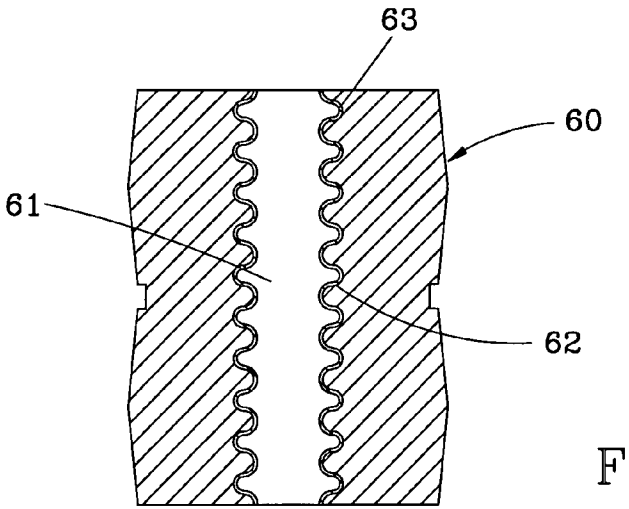
FIG. 4 is a cross-sectional view of an independent barrel according to a second preferred embodiment of the present invention.
Figure 5:
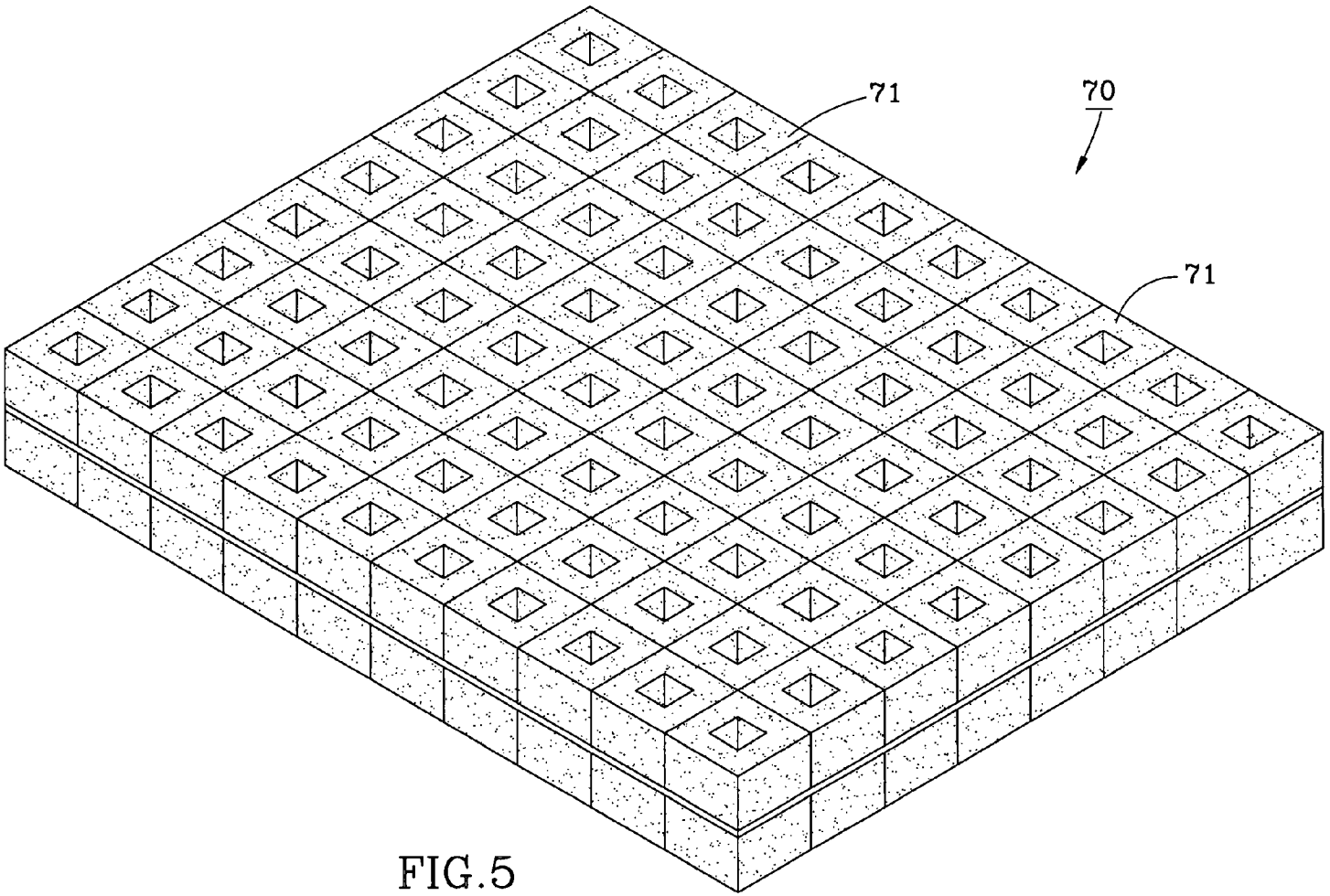
FIG. 5 is a perspective view according to a third preferred embodiment of the present invention.

In addition, a mattress cover (not shown) can be mounted around the combination mattress 10, and the independent barrels can be replaced by other structure. As shown in FIG. 4, an independent barrel 60 of a combination mattress in accordance with the second preferred embodiment of the present invention comprises a recess 61 with a corrugated inner peripheral face 62. The recess 61 of the independent barrel 60 has an air cell 63 inside, thus, the independent barrel 60 has its elasticity, and the air cell 63 increases the structure variation of the independent barrel 60. As shown in FIG. 5, a combination mattress 70 in accordance with the third preferred embodiment of the present invention comprises a plurality of independent barrels 71, which are a square post respectively.

What is claimed is:

1. A mattress, comprising a plurality of independent barrels each having two resting faces and an outer peripheral face extending between the two resting faces, each independent barrel having a recess extended through the two resting faces thereof, wherein the independent barrels are combined together with the outer peripheral faces abutting mutually, wherein the recess of each independent barrel has a first opening at one of the resting faces and a second opening, which is greater in diameter than the first opening, at the other resting face.

2. The mattress as claimed in claim 1, wherein the recess of each independent barrel is installed with an elastic air cell.

3. The mattress as claimed in claim 1, further comprising at least one fixing member for connecting the independent barrels.

4. The mattress as claimed in claim 3, wherein the outer peripheral face of each independent barrel has a positioning groove, and the fixing member is disposed in the positioning groove.

5. A mattress, comprising a plurality of independent barrels each having two resting faces and an outer peripheral face extending between the two resting faces, each independent barrel having a recess extended through the two resting faces thereof, wherein the independent barrels are combined together with the outer peripheral faces abutting mutually, wherein the recess of each independent barrel has a first inner peripheral face and a second inner peripheral face, wherein the first inner peripheral face extends from one of the resting faces in a gradually divergent manner, and the second inner peripheral face extends from the first inner peripheral face toward the other resting face in a gradually convergent manner.

6. A mattress, comprising a plurality of independent barrels each having two resting faces and an outer peripheral face extending between the two resting faces, each independent barrel having a recess extended through the two resting faces thereof, wherein the independent barrels are combined together with the outer peripheral faces abutting mutually wherein the recess of each independent barrel has a wall having a corrugated shape.

7. The mattress as claimed in claim 5, wherein the recess of each independent barrel is installed with an elastic air cell.

8. The mattress as claimed in claim 5, further comprising at least one fixing member for connecting the independent barrels.

9. The mattress as claimed in claim 8, wherein the outer peripheral face of each independent barrel has a positioning groove, and the fixing member is disposed in the positioning groove.

10. The mattress as claimed in claim 6, wherein the recess of each independent barrel is installed with an elastic air cell.

11. The mattress as claimed in claim 6, further comprising at least one fixing member for connecting the independent barrels.

12. The mattress as claimed in claim 11, wherein the outer peripheral face of each independent barrel has a positioning groove, and the fixing member is disposed in the positioning groove.

* * * * *